US005653062A

United States Patent [19]

Shustov

[11] Patent Number: 5,653,062

[45] Date of Patent: Aug. 5, 1997

[54] BLAST PROTECTIVE STRUCTURAL SYSTEM

[76] Inventor: Valentin Shustov, 536 3/4 N. Genesee Ave., Los Angeles, Calif. 90036

[21] Appl. No.: 551,474

[22] Filed: Nov. 1, 1995

[51] Int. Cl.[6] ..... E04H 9/04

[52] U.S. Cl. ..... 52/1; 52/64; 52/167.5; 52/167.6; 52/573.1; 52/773; 52/775

[58] Field of Search ..... 52/1, 167.5, 167.6, 52/64, 773, 775, 573.1–167.4

[56] References Cited

U.S. PATENT DOCUMENTS 5,442,883 8/1995 Nishimura et al. ..... 52/1 X

*Primary Examiner*—Christopher T. Kent

[57] ABSTRACT

A manufacture to protect a building from destructive explosions, having a number of sliding connectors, each connector comprises a massive housing rigidly coupled to a structural frame of the protected building and a low friction slider fixed to a wall panel. Each housing comprises a grooved track for the slider, and each track is sagged down to its middle where the slider rests under normal conditions. When the blast occurs, the wall panel does not transfer its impulse to the building frame immidiately but, remaining parallel to its initial position, distributes this transferal during a sequence of pendulum type excursions thus considerably mitigating the explosion impact on vital structural elements of the building.

1 Claim, 1 Drawing Sheet

BLAST PROTECTIVE STRUCTURAL SYSTEM

BACKGROUND OF THE INVENTION

1. Field of the Invention

The present invention relates to blast protective structural systems. More particularly, the invention relates to protection against terrorist bombing.

2. Description of the Prior Art

It is widely believed that a building subject to explosive blast loading has a chance to remain standing only if it possesses some extraordinary resistive ability (Bulson, 1994). This belief rests, obviously, on the assumption that the specific impulse or the time integral of pressure, which is the dominant characteristic of the external load, is beyond our control.

Fortunately, the last statement is just half-true. We, actually, cannot control the magnitude of the load itself but we can influence the timing of its application to structural elements as well as the pattern of interaction of those elements, and this may make a difference.

SUMMARY OF THE INVENTION

After the shock air wave approaches a wall of the building, the primary hit to the structural system is accepted by the wall panels which are likely to collapse mostly due to excessive flexure or shear deformations. The next, the most severe hit, creating a potential for the general collapse, is accepted by the external elements of the structural frame (columns and girders) which have to bear both the direct blast pressure and the horizontal loads transferred from the wall panels.

It is possible to considerably mitigate those hits by a controllable interruption of lateral contacts between the panels and the frame. This is the concept presented in FIG. 1 through 3.

BRIEF DESCRIPTION OF THE DRAWINGS

In the description of the invention herein presented, references are made to the accompanying drawings, in which.

DESCRIPTION OF THE PREFERRED EMBODIMENT

Figure 1:
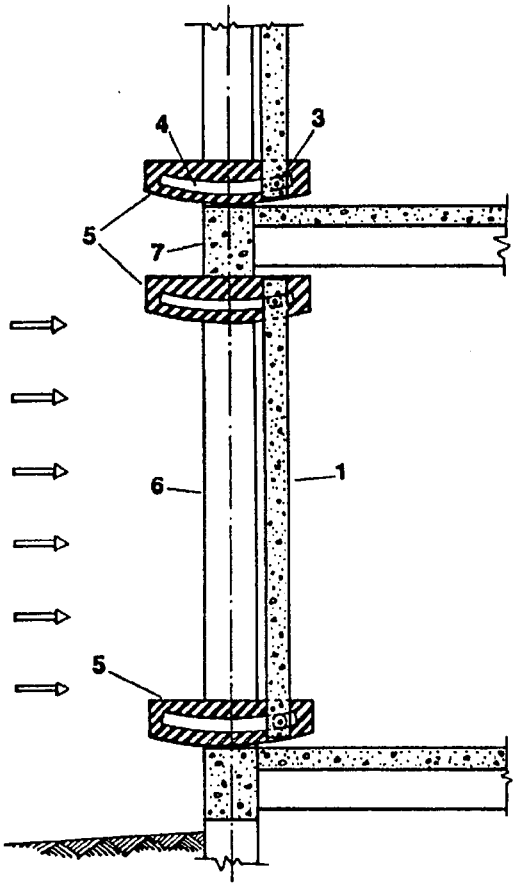
FIG. 1 is an elevation of a blast protective structural system.
Figure 2:
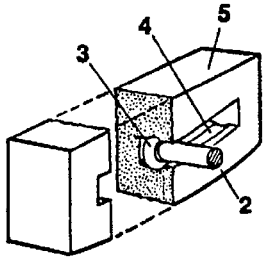
FIG. 2 is a sliding connector.

The present invention will be described with references to the accompanying drawings. As illustrated at FIG. 1, the blast protective structural system according to the invention has a wall panel 1 which can be laterally separated from a column 6 and girder 7 with the help of sliding connectors 5 (see also FIG. 2). The sliding connector 5 is a low friction gravitational pendulum made as a housing in which a pin 2 from the panel 1 is inserted in a ball bearing 3 capable to roll along a groove 4 which is sagged down.

When the blast impulse has developed, the panel 1 is not transferring its load share to the frame elements 6 and immediately, but, remaining vertical, is smoothly transforming its kinetic energy of translation into potential energy of elevation. The horizontal component of the panel's induced pressure on the frame, as well as the corresponding frame reactions, remain relatively small and are controlled by the groove 4 curvature.

The blast protective structural system has several obvious advantages, namely:

1. It is simple and is able to perform satisfactorily under severe conditions of spacial distortions.

2. It can be operational both in case of external and internal explosion.

3. It will not create significant inconveniences in protected premises and will restore its initial, pre-explosion position after several excursions.

Figure 3:
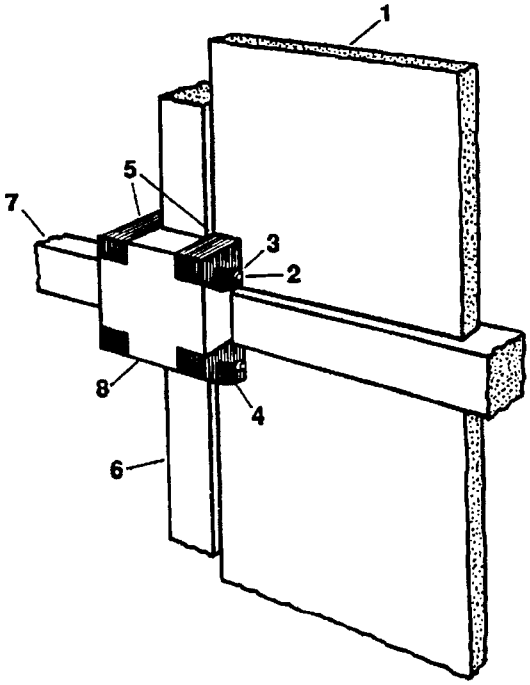
FIG. 3 is a 3-D fragment of a blast protective structural system.

Sliding connectors 5 may be integrated into a monolithic block or a nodal expansion 8 shown at FIG. 3 which will increase the overall capability of the structure to withstand lateral loads.

What is claimed:

1. A blast protective structural system including in combination, a building wall panel, a building structural frame, and a plurality of housings and sliders supporting said building wall panel; said plurality of housings being attached to a structural frame of a building to separate dynamic reactions of said building wall panel from dynamic reactions of said structural frame for protection of said building from destructive explosions, said blast protective structural system comprising:

a plurality of housings rigidly coupled to said structural frame of said building, each of said housings having a grooved track for receiving a slider, each of said grooved tracks being sagged down in a middle portion for said slider to remain at rest under blast-free conditions;

a building wall panel supported on a plurality of low friction sliders, each of said sliders being inserted into, and in rolling contact along, a respective one of said grooved tracks of a respective one of said housings;

each of said grooved tracks having a vertical curvature permitting said building wall panel to move in a direction of a blast and return to said middle portion with reasonably small resistance while retaining an initial vertical position of said building wall panel in a process of post-blast excursions.

* * * * *